United States Patent [19]

Rabus et al.

[11] 4,228,778

[45] Oct. 21, 1980

[54] EXTENDED SPARK CAPACITOR DISCHARGE IGNITION SYSTEM

[75] Inventors: Friedrich Rabus, Schwieberdingen; Günter Gräther, Pinache, both of Fed. Rep. of Germany

[73] Assignee: Robert Bosch GmbH, Stuttgart, Fed. Rep. of Germany

[21] Appl. No.: 932,802

[22] Filed: Aug. 11, 1978

[30] Foreign Application Priority Data

Sep. 22, 1977 [DE] Fed. Rep. of Germany ..... 2742641

[51] Int. Cl.[3] ..... F02P 3/00

[52] U.S. Cl. ..... 123/605; 123/607; 123/640; 123/179 BG; 315/209 CD

[58] Field of Search ..... 123/148 R, 148 AC, 148 B, 123/148 E, 148 CA, 148 CB, 148 DS, 179 BG, 117 R; 315/209 CD

[56] References Cited

U.S. PATENT DOCUMENTS

| | | | |
|---|---|---|---|
| 3,280,809 | 10/1966 | Issler | 123/148 CB |
| 3,303,385 | 2/1967 | Staiger | 123/148 CA |
| 3,636,936 | 1/1972 | Schuette et al. | 123/148 CB |
| 3,760,782 | 9/1973 | Meyer et al. | 123/148 E |
| 3,906,919 | 9/1975 | Asik et al. | 123/148 CB |
| 3,926,165 | 12/1975 | Merrick | 123/148 E |
| 3,945,362 | 3/1976 | Neuman et al. | 123/148 E |
| 3,972,315 | 8/1976 | Munden et al. | 123/148 E |
| 4,068,643 | 1/1978 | McKechnie | 123/148 CA |
| 4,112,890 | 9/1978 | Manger et al. | 123/117 R |
| 4,149,508 | 4/1979 | Kirk et al. | 123/148 E |

*Primary Examiner*—Charles J. Myhre
*Assistant Examiner*—Andrew M. Dolinar
*Attorney, Agent, or Firm*—Frishauf, Holtz, Goodman & Woodward

[57] ABSTRACT

To combine the advantage of a capacitor discharge ignition system, in which the spark intensity is essentially independent of engine speed even at high speeds of the engine, and the extended spark discharge of electromagnetic coil storage ignition by interrupting current through an ignition coil, an ignition event control circuit—for example a breaker contact, optical or electromagnetic transducer or the like—controls a discharge circuit through a capacitor which, after having been charged, suddenly and abruptly discharges through the ignition coil to generate an ignition event. Triggering of the ignition event also initiates repetitive energization of the ignition coil, under control of a frequency generator, which is then connected to the ignition coil to repetitively cause current flow, and abrupt interruption thereof, so that the spark duration, initiated for discharge of the capacitor, is extended. To provide for sufficient ignition energy upon starting, the starting switch can be connected to override the charge circuit to the capacitor so that current flow through the ignition coil, alone, stores sufficient electromagnetic energy for generation of the spark; the slight delay incurred thereby, and the longer current flow time to store sufficient electromagnetic energy is acceptable for operation of the engine under starting conditions.

10 Claims, 2 Drawing Figures

EXTENDED SPARK CAPACITOR DISCHARGE IGNITION SYSTEM

Figure 1:
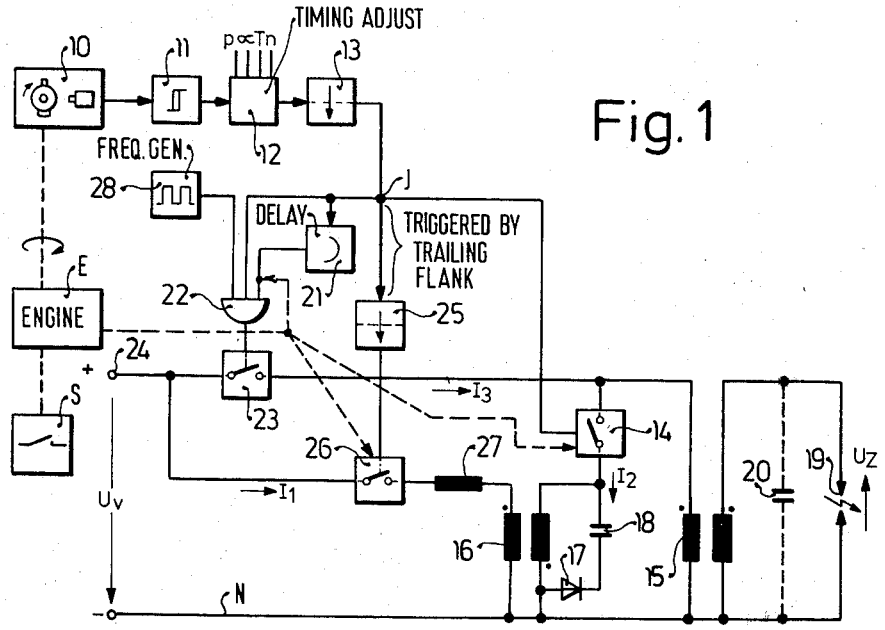

The present invention relates to an ignition system for Otto-type internal combustion engines in which the advantages of capacitor discharge—essential independence of spark energy of the system from engine speed—are combined with the advantages of electromagnetic energy storage in the ignition coil providing, essentially, immunity of the system to low network or supply voltage conditions, and which still provides for extended spark discharge.

BACKGROUND AND PRIOR ART

Extended spark discharge systems have the advantage that, after initial breakdown of a spark across the spark plug, subsequent sparks are generated to effect more efficient combustion of the fuel-air mixture. One such system is disclosed in U.S. Application Ser. No. 776,735, filed Mar. 11, 1977, now U.S. Pat. No. 4,181,112, (to which German Disclosure Document DE-OS No. 26 11 596 corresponds). Extended spark discharge systems of that type are particularly suitable for use with electromagnetic storage ignition coils which use a low primary charge current, have high efficiency, and have high recharge current efficiency, so that the overall efficiency of the system is good, and the operating characteristics are excellent. Such electromagnetic storage-ignition systems do have a disadvantage, however, which is particularly apparent at high speeds, and especially in high-speed engines. Due to the relative low charge current, a certain time delay occurs in storing the initial electromagnetic energy needed for breakdown of the spark at the spark plug. Spark advance, that is, the timing of the first breakdown of the spark gap at the spark plug, may not be possible over the entire adjustment range extent, however, particularly at high speeds, since the relatively low charge current causes a delay in storage of sufficient electromagnetic energy in the coil to initiate the first breakdown.

It has previously been proposed to combine the electromagnetic storage principle of spark plugs with capacitor discharge systems—see, for example, U.S. Pat. No. 3,280,809 and German Disclosure Document DE-OS No. 23 38 905; the combination of the two ignition systems—capacitor discharge and electromagnetic storage—of these disclosures is used for an entirely different object, however, particularly in order to ensure reliable ignition even under poor operating and maintenance conditions, for example upon corrosion, dirt, and the like, in contacts and associated elements. The capacitor discharge is used as an override for the electromagnetic discharge system in order to be able to generate sparks with high ignition voltage so that poor electrical condition of the system will not interfere with generation of at least some ignition events.

THE INVENTION

It is an object to improve ignition systems having an extended spark discharge which is still operable and efficient at high engine speeds regardless of spark advance.

Briefly, the advantages of a capacitor discharge system—essential immunity to variations in engine speed and spark advance, that is, high charge rate and hence short energy storage time—are combined with the advantages of an electromagnetic storage discharge system—high efficiency, essential immunity to low supply voltages, and simplicity of providing for extended spark discharge, by controlling an ignition event in a dual system: The ignition control switch, which may be a breaker, an electromagnetic, optical transducer, or the like, controls a first ignition system which, essentially, is a capacitor discharge system and additionally a second system, which is an extended spark electromagnetic storage discharge system. The second system provides for an extended spark, with a slight time delay, after the first spark has been inititiated upon capacitor discharge.

In accordance with a feature of the invention, and to provide, reliably, a spark even under low battery voltage conditions arising, for example, upon starting, the starting switch can be so connected with the discharge system that an override is provided with respect to the capacitor system so that, upon starting, the ignition coil operates entirely as an electromagnetic storage coil. The slight time delay occasioned thereby and the longer charge current necessary does not substantially affect operation of the engine under starting conditions.

The system has the advantage that it can be so arranged that a leading signal flank which, for example, should trigger the ignition, that is, generate an ignition event, causes discharge of a capacitor at the desired instant, with recharge of the capacitor being effect almost instantaneously. Further discharge sparks at the ignition coil, to provide for the extended spark discharge, are then generated by switch-over to an electromagnetic storage discharge system which is characterized by low primary charge current, high efficiency, and high recharge current.

DRAWINGS

Figure 2:
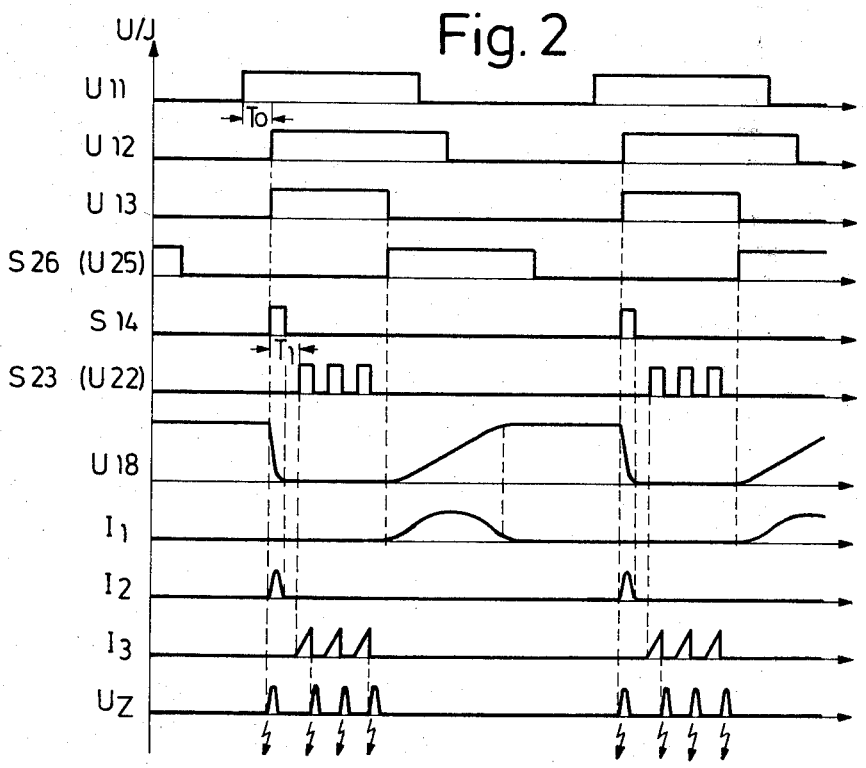

Illustrating a preferred example, wherein:

FIG. 1 shows the general circuit arrangement of the combined capacitor-electromagnetic storage system with extended spark discharge; and FIG. 2 is a series of pulse diagrams which illustrate voltages and currents arising in the system of FIG. 1, which will be referred to in connection with the explanation of the operation of the system of FIG. 1.

The crankshaft of an internal combustion engine E is coupled to a signal transducer 10 which provides ignition event signals. Transducer 10 may be a breaker-type system, an electromagnetic transducer, an optical transducer, a Hall generator, a Wiegand wire transducer, or any other suitable transducer providing ignition control signals. The transducer 10 is coupled to a wave-shaping circuit 11 which, in its simplest form, is a Schmitt trigger, providing a square wave output. The output from wave-shaping circuit 11 is coupled to a timing adjustment circuit 12 which has inputs representative of engine operation and operating parameters to adjust the ignition timing. Typical operating parameters are induction pipe pressure (or, rather, vacuum), throttle deflection angle, temperature, engine speed—all as shown by respective input lines—and other parameters which may be desirable, for example exhaust gas composition. The circuit 12 may receive the data in analog form—see U.S. Pat. No. 3,874,351 (to which German Disclosure Document DE-OS No. 23 48 352 corresponds), or in digital form—see U.S. Pat. No. 4,099,495, Kiencke et al (to which German Disclosure Document DE-OS No. 25 39 113 corresponds). The timing adjustment circuit 12 shifts the ignition timing in dependence on these operation or operating parameters and applies its output to a timing circuit 13. Timing circuit 13 which may, for example, be a monostable multivibrator, provides the actual ignition event control signals. Accordingly, timing circuit 13 is connected to a main junction J from which various branch circuits emanate.

Junction J is connected to a capacitor discharge circuit essentially including a controlled switch 14 and a capacitor 18. The junction J is connected to the control terminal of switch 14. Switch 14, preferably, is a thyristor, but may be a transistor. If a transistor is used then, preferably, an inductance coil is serially connected to the main current-carrying path thereof in order to decrease the current flow therethrough. The first switching contact of the electrical controlled switch 14 is connected to the primary of ignition coil 15, the secondary of which is connected to a ground, chassis or reference bus N. The other main terminal of switch 14 is connected to a parallel circuit including the secondary of a transformer 16, the other terminal of which is connected to chassis bus N, and the series circuit of a storage capacitor or ignition discharge capacitor 18 and diode 17. The secondary of ignition coil 20 is connected to spark plug 19; for a multi-cylinder internal combustion engine, a distributor would be interposed between the secondary of the ignition coil 15 and the plurality of spark plugs 19. The capacity 20, shown connected in broken lines, represents the equivalent capacity of the cabling or ignition wire distribution system of the connection of the secondary of spark plug 15 to the distributor (if used) and the respective spark plug or spark plugs 19.

Junction J is additionally connected to a time delay circuit 21 and then to the input of an AND-gate 22. A frequency generator 28 is connected to another input of the AND-gate 22. Junction J is further directly connected to the input of the AND-gate 22. The output of AND-gate 22 is connected to a controlled second electrical switch 23 which, preferably, is a transistor. The positive terminal 24 of the supply Uv is connected through the main current-carrying path of switch 23 with the primary of the ignition coil 15 and hence also to one of the main current-carrying terminals of the switch 14.

To charge the capacitor 18, a charge circuit is provided as follows: Junction J is connected to a timing circuit 25 which, in turn, controls opening and closing of a third electrical switch 26. The timing circuit 25, preferably, is triggered by the trailing or reset flank of the timing circuit 13. The main current-carrying path of switch 26 which, preferably, is a solid-state switch, for example of the transistor or thyristor type, is connected from bus 24 through an inductance 27 to the primary of transformer 16 and then to ground or chassis bus N.

Operation, with reference to FIG. 2: The signal from the transducer 10 which, typically, is an undulating signal, is transformed in the wave-shaping circuit 11 to a pulse-type, square wave signal U11. The ignition timing adjustment circuit 12 delays this signal by a time interval To, in dependence on the parameters applied thereto, so that an output signal U12 appears at the output of circuit 12. The signals of FIG. 2 have been given numerical designations corresponding to the elements of FIG. 1. Signal U12 is applied to the timing circuit 13 which establishes a time interval upon sensing the leading flank of signal U12. Signal U13 triggers switch 14, preferably a thyristor, to become conductive. Consequently, energy stored in capacitor 18 can discharge through the primary of ignition coil 15. The voltage across capacitor 18 decreases in accordance with the curve U18—FIG. 2—inducing a current pulse I2 in the primary of ignition coil 15. The energy stored in the capacitor 18 is rapidly transferred to the secondary, and to the capacity represented by the ignition cable capacity. The time of transfer is extremely rapid, in the order of about 20 microseconds, and as soon as the breakdown voltage of the spark plug 19 is reached, a spark will jump over. The spark voltage at the ignition is shown in the last line of FIG. 2 at $U_Z$. When the current I2 drops below the holding current of the thyristor 14, thyristor 14 will block.

The signals from the frequency generator 28 can reach the switch 23 with a delay by the time T1, as established by the delay element 21. Switch 23 will open and close in sequence with the frequency generated by frequency generator 28, that is, in accordance with the output from gate 22, namely voltage U22. Each signal U22 causes flow of primary current I3 through the primary of ignition coils 15; as soon as switch 23 opens, an inductive voltage kick is induced in the secondary of ignition coil 15, causing a further breakdown of spark gap 19. When the timing circuit 13 drops off, that is, when the signal U13 terminates, gate 22 blocks and no further sparks will arise at the spark plug 19.

The trailing flank of signal U13 triggers the timing circuit 25. Timing circuit 25, by the signal U25, causes switch 26 to become conductive. Current I1 will then flow, gradually rising, through the switch 25 and inductance 27 to the transformer 16 for a time of about 2 milliseconds, to charge the capacitor 18 to a voltage of about between 100 to 200 V. Neither this voltage nor the time limits are critical and will depend on the design of the system, and on the combustion with which the system is to be used. The voltage rise across capacitor 18 is shown at curve U18 in the region corresponding to the undulating curve I1. When signal U25 terminates, switch 26 opens. The capacitor 18 will retain its charge since it cannot discharge through the diode 17, which blocks reverse current. The inductance 27 ensures gradual current rise through the transformer and thus practically loss-less charge of the capacitor 18.

The secondary of the ignition coil 15 may have a high-voltage diode connected therein in order to obtain charge accumulation. Instead of a frequency generator 28 with fixed frequency, a frequency generator is described in U.S. Pat. No. 4,083,347 (to which German Disclosure Document DE-OS No. 26 06 890 corresponds) may be used; in such a frequency generator, the length of the signals is determined by the current rise time of the primary of the ignition coil 15.

The duration of the extended spark, determined by the timing circuit 13, can also be limited or determined otherwise, for example by a circuit which responds to angular change of rotation of the crankshaft of the engine coupled, for example, to transducer 10. The transducer 10 can be used, therefore, to provide a speed-dependent timing signal which, in other words, means a signal having a duration corresponding to the time taken by the crankshaft of the engine to change over a particular angular range, to movement of a poston of the engine to a predetermined position with respect to top dead center (TDC) position.

The voltage U18 across the capacitor is proportional to the supply voltage across buses 24 and N, since the transformer 16 operates as a current transformer. When operating a starter motor from the battery of an automotive vehicle, the voltage drops considerably so that, upon starting—just when a hot spark is needed—the output voltage may be insufficient. In order to obtain sufficient voltage reserve for ignition, even if the starting voltage supply should be below nominal value, the starter switch of the engine, schematically shown at S, can be coupled to the switches 14 and 26 so that switch 23 will become immediately effective to provide a series of ignition pulses based on current flow and interruption thereof through coil 15. There is some delay in the generation of the initial spark due to charge delay; this delay may be a few hundred microseconds and, under starting conditions, is not significant and does not interfere with starting operation of the engine. Rather than using the starter switch as an override for the switches 14, 26, a speed sensing arrangement can be coupled to the engine so that the control operation of switches 14 and 26, as determined by the signal at junction J, is inhibited if the speed of the engine drops below a predetermined value which may also be a speed of zero or stopped condition, so that, upon starting of the engine, be inhibition due to low engine speed, the switches 14, 26 are not used to generate a spark.

The switch S is a speed responsive switch, that is, responds when the speed of the engine is below a certain level. This response can be controlled manually—when the switch S is coupled to the starter switch—or automatically from the engine. The operation of the switch, as shown in broken lines in FIG. 1, affects the capacitor control switches 14, 26 and, preferably, also overrides the delay by the delay circuit 21, for example by providing an enabling signal to the third input of the AND-gate 22, for example through a buffer or a suitable OR-gate, so that the AND-gate 22 will be enabled if the engine speed drops below a certain level when an ignition event is commanded by a signal appearing at junction J, so that pulses from the frequency generator 28 then can be transferred directly to the ignition coil. Any delay due to the pulsing from frequency generator 28 is small and will not adversely affect operation of the engine at low speeds.

Various changes and modifications may be made within the scope of the inventive concept.

We claim:

1. Extended spark composite capacitor discharge and ignition coil electromagnetic storage ignition system for an internal combustion engine (E) having ignition signal generating means (10—13) coupled to the engine (E) and providing an ignition event signal at a predetermined angular position of the crankshaft of the engine, an ignition coil (15) having a primary and secondary, and at least one spark gap (19) connected to the secondary of the ignition coil, and a source (24) of electrical power, and comprising, in accordance with the invention, the combination of a high-voltage capacitor discharge ignition system including a capacitor (18);

capacitor charge control circuit means (16, 17, 26, 27) connected to said source (24) and controlling charging of the capacitor;

and a capacitor discharge switch (14) connected to and controlled by said ignition signal generating means, said ignition event signal controlling the capacitor discharge switch (14) to connect the capacitor to the ignition coil to discharge the capacitor through said coil and initiate an ignition event;

with an extended spark electromagnetic storage discharge system including a coil current control switch (23) connected to said source (24) controlling current flow to the ignition coil (15);

and a pulse control generation means (28) controlling generation of a plurality of extended spark discharge signals, and controlling closing of said current control switch (23) to close repetitively to permit current flow through the primary of the ignition coil from said source independently of current flow therethrough upon discharge of the capacitor, and under command of said pulse control generation means, said ignition signal generating means further being connected to control the first closing of said coil current control switch (23) to occur under control of said ignition signal generating means and as a function of said ignition event signal;

and further comprising a delay circuit (21) coupled to and controlled by the ignition signal generating means and controlling said coil current control switch (23) to delay closing thereof until the capacitor (18) has discharged upon operation of the capacitor discharge switch (14) to provide for an initial spark of the spark gap generated by energy derived from the capacitor (18) and subsequent sparks at the spark gap (19) under control of said pulse control generation means.

2. System according to claim 1, further including timing means (13) connected to the pulse control generation means (28) controlling the duration of application of pulses from said pulse control generation means (28) to limit the plurality of spark discharge to predetermined numbers.

3. System according to claim 1, wherein the capacitor discharge switch (14) is connected to the primary winding of the ignition coil (15) and to the capacitor (18) and forms, when closed, with said capacitor and the primary of the ignition coil a closed electrical circuit.

4. System according to claim 1, wherein the capacitor charge control circuit comprises a charge control switch (26) connected to the source (24) and a transformer (16) having a primary connected to the charge control switch, a secondary of the transformer being connected to said capacitor (18);

and a reverse current blocking diode (17) serially connected between the secondary of the transformer (16) and the capacitor to prevent discharge of the capacitor upon de-energization of the transformer (16).

5. System according to claim 4, further including a control circuit (25) connected to the ignition signal generating means and energizing said transformer (16), said control circuit controlling operation of the charge control switch (26) during gaps between succeeding ignition events.

6. System according to claim 5, further including an inductance serially connected with the primary of the transformer (16) and said charge control switch (26).

7. System according to claim 1, further including an override switch (S) connected to the capacitor discharge switch (14) to override operation thereof, said override switch being operative at speeds of the engine below a predetermined value to disable the high-voltage capacitor ignition system and to generate sparks at said spark gap (19) by the extended spark electromagnetic storage discharge system under the sole control of said coil current control switch (23).

8. System according to claim 7, further including circuit means connected to the delay circuit (21) and to said override switch to cause said override switch to bridge the delay circuit when operated.

9. System according to claim 7, wherein the override switch comprises an engine speed responsive switch.

10. System according to claim 7, wherein said override switch comprises the starter switch of the engine.

* * * * *